US008875428B2

(12) United States Patent
Rowe et al.

(10) Patent No.: US 8,875,428 B2
(45) Date of Patent: Nov. 4, 2014

(54) SELECTIVELY DEPLOYABLE TAB INDICATORS

(75) Inventors: Michael D. Rowe, Medway, OH (US); Edward P. Busam, Mason, OH (US); Kenneth P. Richied, Cincinnati, OH (US); Elizabeth M. Lacher, Beavercreek, OH (US)

(73) Assignee: Acco Brands Corporation, Lake Zurich, IL (US)

( * ) Notice: Subject to any disclaimer, the term of this patent is extended or adjusted under 35 U.S.C. 154(b) by 170 days.

(21) Appl. No.: 13/453,554

(22) Filed: Apr. 23, 2012

(65) Prior Publication Data

US 2012/0233894 A1 Sep. 20, 2012

Related U.S. Application Data

(63) Continuation-in-part of application No. PCT/US2011/049321, filed on Aug. 26, 2011.

(60) Provisional application No. 61/377,822, filed on Aug. 27, 2010.

(51) Int. Cl.
*G09F 23/10* (2006.01)

(52) U.S. Cl.
CPC ..... *B24F 21/10* (2013.01)
USPC ..... 40/641

(58) Field of Classification Search
CPC ..... B42F 17/12; B42F 21/02; B42F 21/04; B42F 21/08; B42F 21/10
USPC ..... 40/641, 376, 390
See application file for complete search history.

(56) References Cited

U.S. PATENT DOCUMENTS

| | | | | |
|---|---|---|---|---|
| 1,048,577 | A * | 12/1912 | Pardoe | 40/359 |
| 1,732,686 | A * | 10/1929 | Krell | 40/641 |
| 2,878,814 | A * | 3/1959 | Consaul | 40/359 |
| 2,895,448 | A * | 7/1959 | Haines | 116/324 |
| 4,031,647 | A | 6/1977 | Thomas | |
| 6,511,246 | B2 * | 1/2003 | Sapienza et al. | 402/79 |
| 7,591,093 | B2 | 9/2009 | Saylor | |
| 7,610,707 | B1 * | 11/2009 | Payne | 40/641 |
| 7,731,442 | B2 | 6/2010 | Barausky et al. | |
| 8,443,534 | B2 | 5/2013 | Goodfellow et al. | |
| 2007/0119082 | A1 * | 5/2007 | Gilchrist | 40/641 |
| 2008/0197176 | A1 | 8/2008 | Decarlo et al. | |
| 2009/0178320 | A1 * | 7/2009 | Goodfellow et al. | 40/641 |
| 2010/0183358 | A1 | 7/2010 | Kelley | |
| 2011/0215135 | A1 | 9/2011 | Goodfellow et al. | |
| 2013/0119120 | A1 | 5/2013 | Dobson | |

FOREIGN PATENT DOCUMENTS

WO 2013/066406 5/2013

OTHER PUBLICATIONS

International Search Report and Written Opinion for PCT/US2011/49321, Jan. 30, 2012.

* cited by examiner

*Primary Examiner* — Gary Hoge
(74) *Attorney, Agent, or Firm* — Thompson Hine, L.L.P.

(57) ABSTRACT

A tab status indicator system including a generally planar body portion and a tab coupled to the body portion and protruding generally outwardly therefrom. The system further includes an indicator movable between a deployed position, in which the indicator generally overlaps with the tab in a direction generally perpendicular to a plane of the body portion, and a retracted position, in which the indicator does not overlap with the tab or overlaps with the tab less than when the indicator is in the deployed position.

23 Claims, 16 Drawing Sheets

SELECTIVELY DEPLOYABLE TAB INDICATORS

REFERENCE TO RELATED APPLICATION

This application is a continuation in part of International Application PCT/US2011/49321 filed Aug. 26, 2011, which claims the benefit of priority under 35 U.S.C. §119(e) of U.S. provisional application Ser. No. 61/377,822 filed on Aug. 27, 2010, which are both hereby incorporated by reference in their respective entireties.

The present invention is directed to a tab status indicator, and more particularly, to a selectively deployable tab status indicator for use on a filer or the like.

BACKGROUND

Filers are often used to store loose-leaf papers, notebooks, handouts or the like. Such filers may include dividers or pockets to facilitate organization of the filer's contents. The dividers or pockets may include label tabs carried thereon to identify the contents and enable ease of access thereto. In many cases, the filer stores items which require attention (i.e. subjects with assigned homework, projects with upcoming deadlines, high priority projects, etc).

However, in order to determine which compartments of the filer require attention, users must typically open the filer and page through the contents of each individual pocket/divider. This requires the user to access the filer, which can be trapped between other components, and also requires additional time and attention.

SUMMARY

Accordingly, in one embodiment, the present invention is a status indicator which is selectively deployable to flag the tabs associated with items requiring attention, or to be used alone without associated tabs. In addition, portions of the divider, filer, or other structure that may contain the status indicators may be generally clear, transparent or translucent to enable a user to identify the flagged tabs from outside the divider or other structure, even when the divider or other structure is closed. More particularly, in one embodiment, the invention is a tab status indicator system including a generally planar body portion and a stationary tab coupled to the body portion and protruding generally outwardly therefrom. The system further includes an indicator movable between a deployed position, in which the indicator generally overlaps with the stationary tab in a direction generally perpendicular to a plane of the body portion, and a retracted position, in which the indicator does not overlap with the tab or overlaps with the tab less than when the indicator is in the deployed position. In another embodiment, the movable indicator may be used without an associated stationary tab.

DETAILED DESCRIPTION

Figure 2:
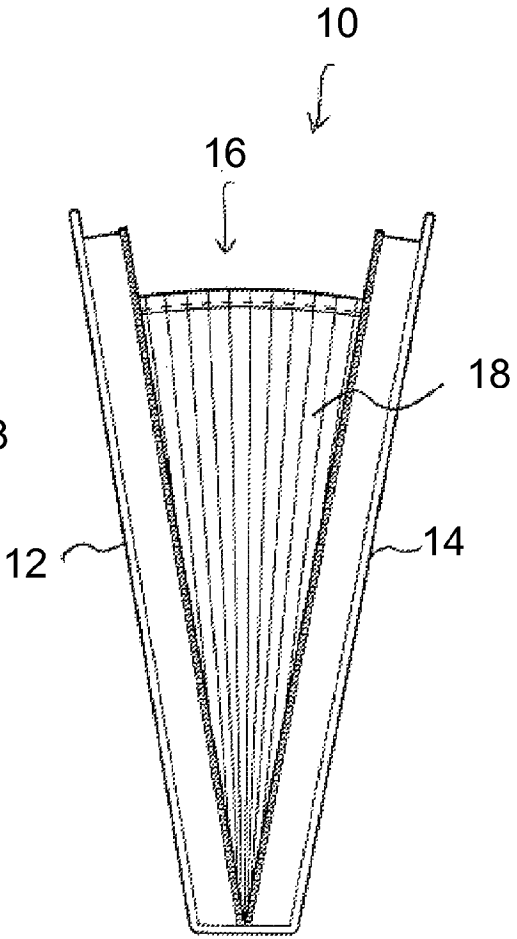
FIG. 2 is a side view of the filer of FIG. 1, shown in the open position.
Figure 1:
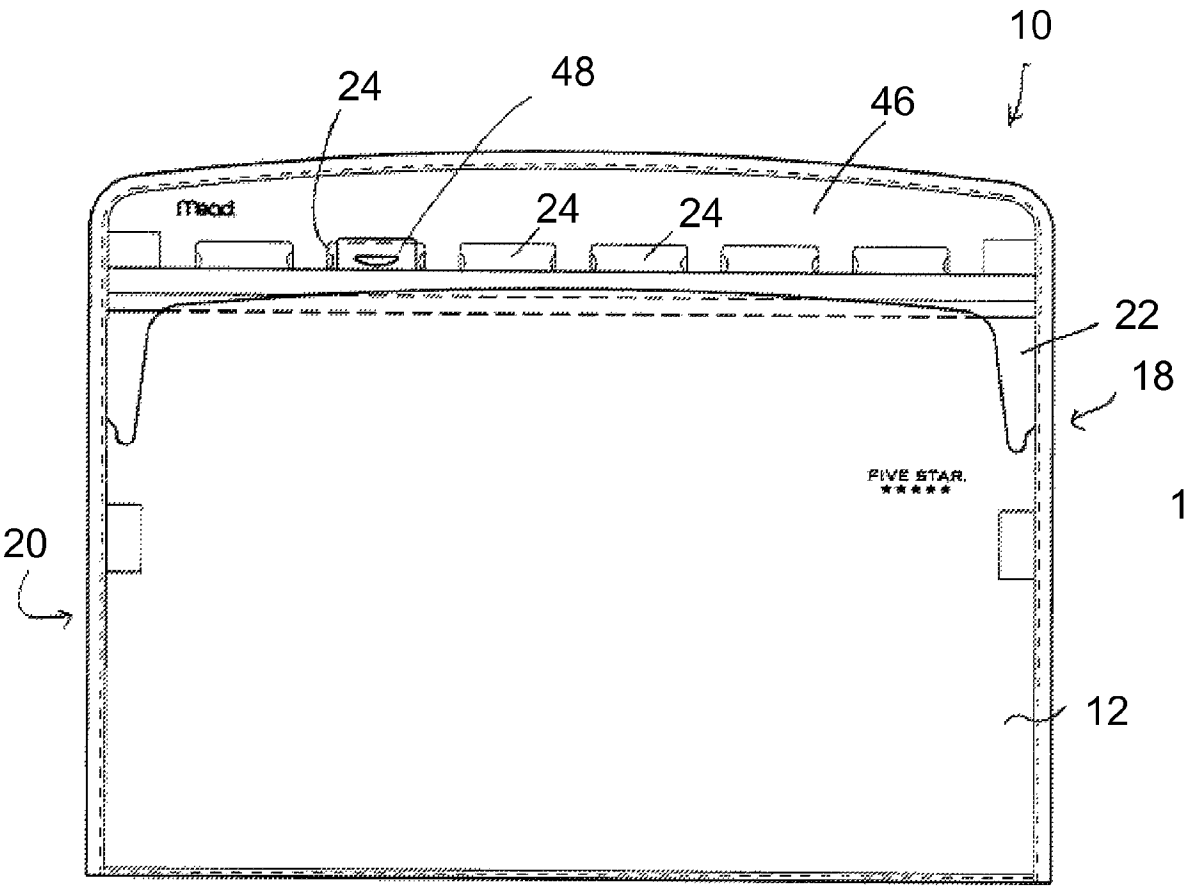
FIG. 1 is a front view of a divider incorporating the tab status indicator system of the present invention.

As shown in FIGS. 1 and 2, the tab status indicator of the present invention may be used in conjunction with a filer 10 including a front cover panel 12 and a rear cover panel 14 bound along a common edge with a storage compartment 16 located therebetween. Alternately the tab status indicator may be used with structures other than a filer, such dividers, organizers, notebooks, binders, and the like. The filer 10 may include a pair of side panels 18, 20 extending between the front 12 and rear 14 panels. As shown in FIG. 2, side panel 18 (as well as the side panel 20; not shown in FIG. 2) may be made of an expandable/collapsible accordion-style material. A fastener, such as a zipper (not shown), may extend around the unbound edges of the front 12 and rear 14 panels to secure the panels 12, 14 together and retain the filer 10 in a closed position.

Figure 3:
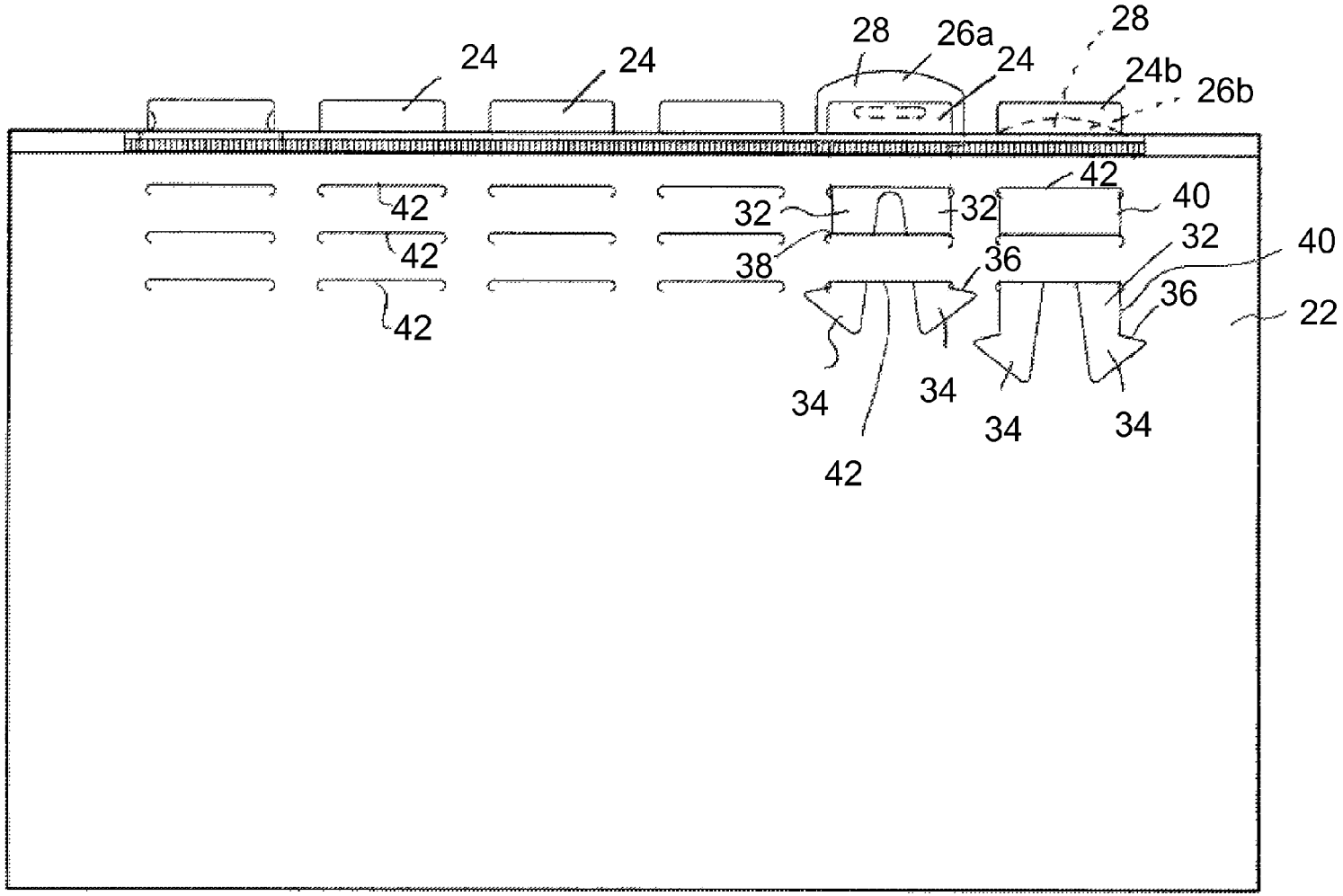
FIG. 3 is a front view of a divider panel of the filer of FIG. 1.

A plurality of divider panels 22 (see FIG. 3) or the like may be positioned in the storage compartment 16. The divider panels may be made of plastic, paper, reinforced or laminated paper, tear-resistant paper, and the like. Each divider panel 22 can be a generally planar, rectangular component oriented generally parallel with the front 12 and rear 14 panels. As can be seen in FIGS. 1 and 3, each divider panel 22 may include a tab 24 coupled thereto and protruding upwardly therefrom. Each tab 24 may be made of a 2-ply piece of material folded over itself to define a cavity therebetween. In this manner, a piece of paper or the like can be inserted into the tab 24 such that the contents of the filer 10 stored adjacent to the associated divider panel 22 can thereby be identified. Alternately, if desired, each tab 24 may be a piece of single-ply material and a user may write or place labeling indicia on the front surface thereof.

Each tab 24 may be generally clear, transparent or translucent, as in the illustrated embodiment. However, it should also be noted that each tab 24 may be generally opaque, and may not necessarily include any labeling indicia therein or carried thereon, but may instead aid a user simply by its protruding shape. The tabs 24 may be made of plastic, paper, reinforced or laminated paper, tear-resistant paper, and the like. In some embodiments, the tabs 24 may be omitted and the tab status indicators 26 used alone.

Figure 4:
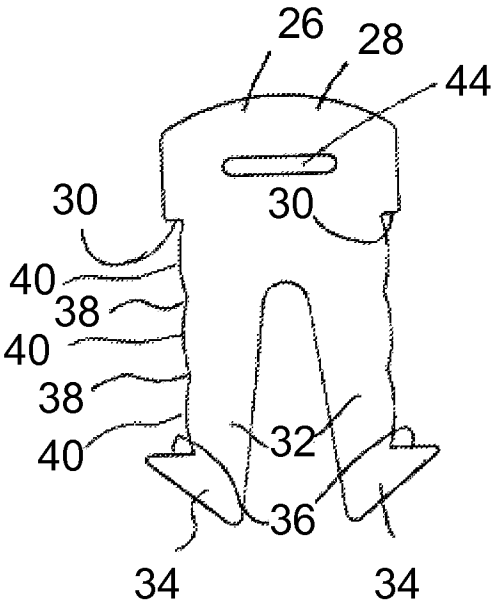
FIG. 4 is a front view of a tab indicator of FIG. 3.

As best shown in FIGS. 3 and 4, the filer 10 may include a plurality of generally flat, planar tab status indicators 26, each indicator 26 being laterally aligned with, and associated with, one of the tabs 24. In the embodiment shown in FIGS. 3 and 4, each indicator 26 includes a body 28 having a pair of lower edges 30. Each indicator includes a pair of diverging legs 32 extending downwardly from the body 28, with each leg 32 terminating in an outwardly-extending foot 34 having an upper edge 36. Each leg 32 includes a pair of notches 38 on an outer edge thereof, each notch 38 being positioned between an adjacent pair of generally convex rounded portions 40. However, instead of a pair of notches, a single notch 38, or three or more notches 38, may be used.

As shown in FIG. 3, the divider panel 22 includes a plurality of sets of vertically spaced slits 42 (three slits 42 in each set in the illustrated embodiment) formed therethrough and positioned below each tab 24. The plurality of slits may include two slits, three slits, four slits, or more than four slits. Each indicator 26 is inserted into, and coupled to, the divider panel 22 by "weaving" the indicator 26 through the various slits 42, such that portions of the indicator 26 are positioned on both sides of the divider panel 22 as shown in FIG. 3. The body 28 of the indicator 26 in the embodiment of FIG. 3 is positioned behind the associated tab 24. However, by "weaving" the indicator 26 in an alternate direction through the various slits 42, or by rotating the divider panel on its vertical axis, the body 28 of the indicator 26 may be positioned in front of the associated tab 24.

Each indicator 26 is movable between a deployed position (see indicator 26*a* of FIG. 3), in which the indicator 26 generally overlaps with the tab 24 in a direction generally perpendicular to the plane of the divider panel 22, and a retracted position (indicator 26*b* of FIG. 3) in which the indicator 26 is retracted and does not overlap with the tab 24, or overlaps with the tab 24 less than when the indicator 26 is in the deployed position. Each indicator 26 is movable in a vertical direction (i.e., in the plane of the divider panel 22) as it moves between the deployed and retracted positions.

Each tab 24 (six tabs 24 in the illustrated embodiment) may each include its own associated indicator 26. In this manner, when the user wishes to flag a particular tab 24, the user moves the associated indicator 26 from its retracted position to its deployed position. Once the indicator 26 is in the deployed position, it highlights or calls attention to the associated tab 24, thereby signaling to the user that the items associated with that divider panel 22 require attention.

In one embodiment, the outer perimeter of the body 28 of each indicator is larger than the perimeter of the associated tab 24 such that the body 28 of the indicator 26 generally surrounds the associated tab 24 when in the deployed position to attract the user's attention. Moreover, each indicator 26 may include a visual property which differs from the associated tab 24 to draw the user's attention. For example, each indicator 26 may be brightly colored, textured or carry various indicia (i.e., the text "Attention") thereon.

As each indicator 26 is moved from its retracted position to its deployed position, the legs 32 of the indicator 26 are forced to move closer together due to the increased width offered by rounded portions 40 as they are forced through the restricted width provided by the slits 42. Once the indicator 26 is received in the deployed (or retracted) position, the legs 32 spring slightly outwardly as the associated notches 38 become aligned with the slits 42, thereby "locking" the legs 32/indicator 26 in place and providing tactile feedback to the user that the indicator 26 is in a stable state. The same locking features and tactile feedback are provided when the indicators 26 are moved from the deployed position to the retracted position. Each indicator 26 may include a cut-out 44 formed in the body portion 26 therein to aid a user in gripping the indicator 26 and moving it between the retracted and deployed positions. If an indicator 26 is opaque, cut-out 44 may be of sufficient size through which to view a portion of tab 24, for example information printed or written on the tab. Although the example on FIG. 3 shows indicators 26 behind tabs 24, the indicators 26 could also be positioned in front of tabs 24.

The bottom edges 30 of the body 28 extend generally perpendicular to the movement of the indicator 26. Thus the bottom edges 30 can be positioned to thereby engage the top slit 42 and/or the top of the divider panel 22 and act as a stop to limit downward movement of the indicator 26 when the indicator 26 is moved to its retracted position. Similarly, the upper edge 36 of each foot 34 engages the lower-most slit 42 to act as a stop and limit any further attempted upward movement of the indicator 26 when the indicator 26 is in the deployed position.

In the embodiment shown in FIG. 3, two indicators 26 are shown coupled to the divider panel 22 for illustrative purposes. However, each divider panel 22 may include only a single indicator 26 coupled thereto, particularly if each divider panel 22 includes only a single tab 24 thereon. Alternately, one divider panel 22 (or even each divider panel 22) can include up to six or more indicators coupled thereto (one for each tab 24 of the divider 22 or filer 10). Moreover, in the embodiment shown in FIG. 3, the divider panel 22 includes six sets of slits 42 formed therein. However, if the divider panel 22 includes only one indicator 26 coupled thereto, the divider panel 22 may include only one set of slits 42 formed therein.

Returning to FIG. 1, at least the upper/distal portion of the front panel 12 may include a generally clear/transparent/translucent portion 46 thereon such that the tabs 24, and their deployed indicators 26, are visible from outside the filer 10, even when the filer 10 is closed. In this manner, the user can ascertain which tabs 24 are flagged, and thereby determine, for example, which tasks the user needs to complete, without having to open the filer 10. If desired, the rear panel 14 may also include a clear/transparent portion at at least a distal end thereof such that the status of the indicators 26 can be viewed from the opposite side of the filer 10.

Each indicator 26 may be generally clear, transparent or translucent such that the associated tab 24 can be viewed through the indicator 26 from either direction thereof. Alternately, each indicator 26 may be generally opaque. If desired, each indicator 26 may be able to be completely removed from the associated divider panel 22 by urging the legs 32 of the indicator 26 together sufficiently that the indicator 26 can be extracted by pulling the indicator 26 (i.e. vertically in the illustrated embodiment) through all three slits 42. This can enable the user to replace damaged indicators 26 or remove unwanted indicators 26. Alternately, if desired, the indicators 26 may be configured to prevent removal, or make removal more difficult.

It is to be understood that tab 24 itself could be movable relative to the divider panel 22, for example being movable from a retracted position to a deployed position. The tab 24 could be attached to the divider panel 22 by means such as legs 32 of the indicator 26 moving in slits 42 or other slits or openings. It is also to be understood that the tab 24 and indicator 26 may be combined in a single structure.

Figure 5:
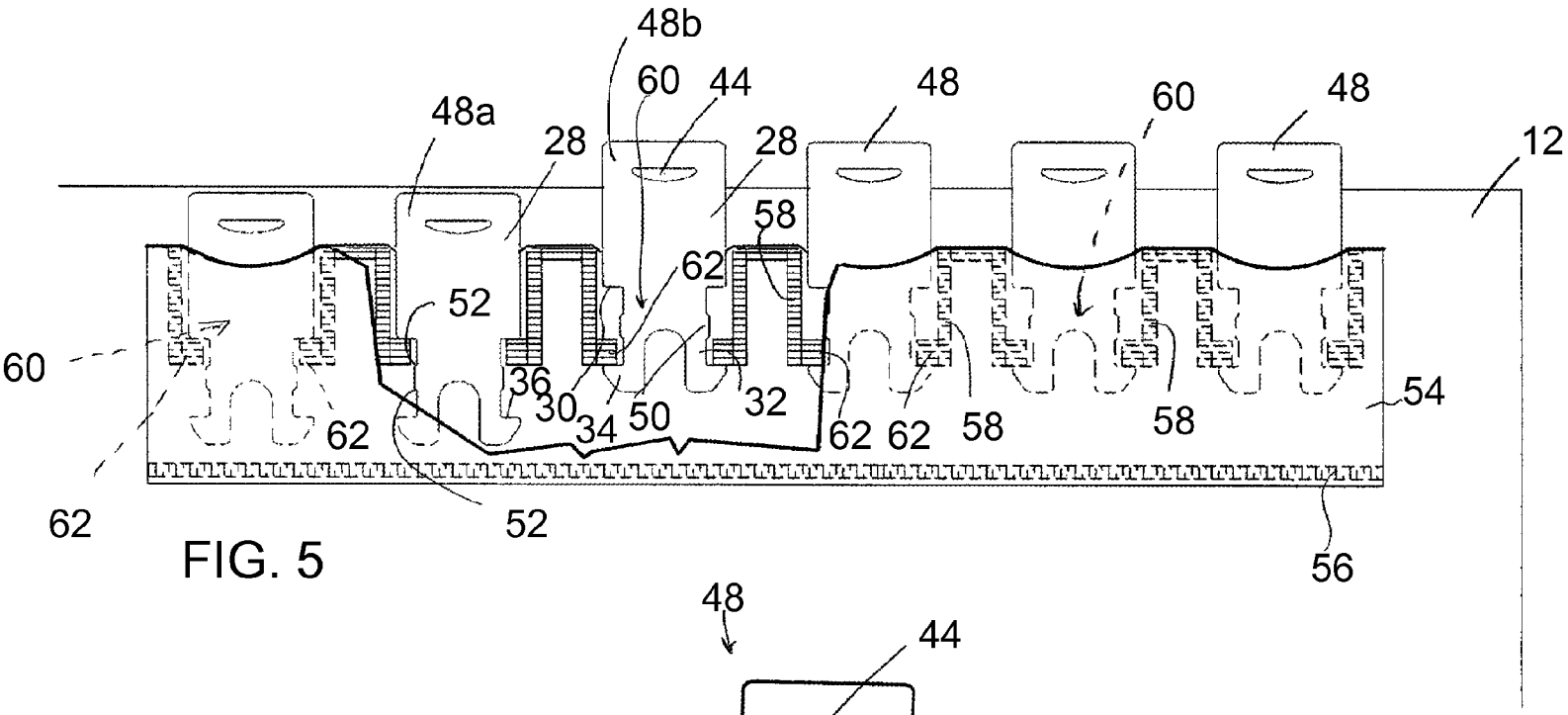
FIG. 5 is an interior, partial cutaway view of an alternative type of status indicators.
Figure 6:
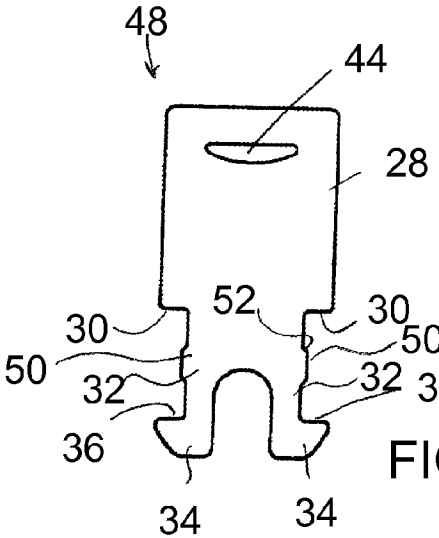
FIG. 6 is a front view of one of the status indicators of FIG. 5.

FIGS. 5 and 6 disclose an alternate embodiment of the indicators 48. In particular, as best shown in FIG. 6, in this embodiment, each indicator 48 includes a body 28 and a pair of downwardly extending legs 32 which are oriented generally straight/vertically. Each leg 32 includes a "knee" or protrusion 50 at about the midpoint thereof.

As shown in FIG. 5, a retaining panel 54 is coupled to an inner surface of front panel 12 of the filer 10. The retaining panel 54 is coupled to the front panel 12 by a weld 56 extending along the bottom thereof, as well as a plurality of generally "L"-shaped welds 58 defining a plurality of indicator-receiving cavities 60 therebetween. Each indicator 48 is received between the retaining panel 54 and the front panel 12 in an indicator-receiving cavity 60 such that the inwardly-extending portion 62 of each weld 58 is positioned adjacent to one of the legs 32.

When an indicator 48 is moved from its retracted position (i.e., indicator 48*a* of FIG. 5) to its deployed or extended position (i.e., indicator 48*b* of FIG. 5), each knee 50 engages an associated inwardly-extending portion 62 of an associated weld 58. In this manner, the user, moving an indicator 48 between the retracted and deployed positions, experiences resistance until the indicator 48 reaches its retracted/deployed position, at which time the indicator "snaps" into place, providing tactile feedback to the user. Each knee 50 may include a pair of tapered surfaces 52 to guide the knees 50 past the inwardly extending portion 62. In the embodiment of FIGS. 5 and 6, the upper edge 36 of each foot 34 engages an inwardly extending portion 62 when the indicator 48 is moved to the deployed position, thereby preventing removal of the indicator 48.

In the embodiment of FIGS. 5 and 6, welding is used to couple the retaining panel 54 to the front panel 12. Welding may for example be used with plastic materials and could be by thermal or sonic methods. It may be advantageous for both the retaining panel 54 and front panel 12 to be made of similar materials. Besides plastic, other materials, such as paper or paperboard, may be used for retaining panel 54 and front panel 12. For paperboard, an adhesive or glued attachment may be used. One or more plies of material may be used for either the retaining panel 54 or the front panel 12. Regardless of material, various operations may be used to construct retaining panel 54 and attach it to front panel 12, such as welding, stitching, stapling, gluing, adhesives, cutting, and folding. Mechanical connections such as rivets, eyelets, rivets, eyelets, or screws may be used. Different types of attachment may be used in combination. The configuration of the retaining panel and any of these types of attachment may be designed so as to allow indicator 48 to move appropriately between retaining panel 54 and front panel 12, and to stop as desired at the retracted and deployed positions.

Figure 7:
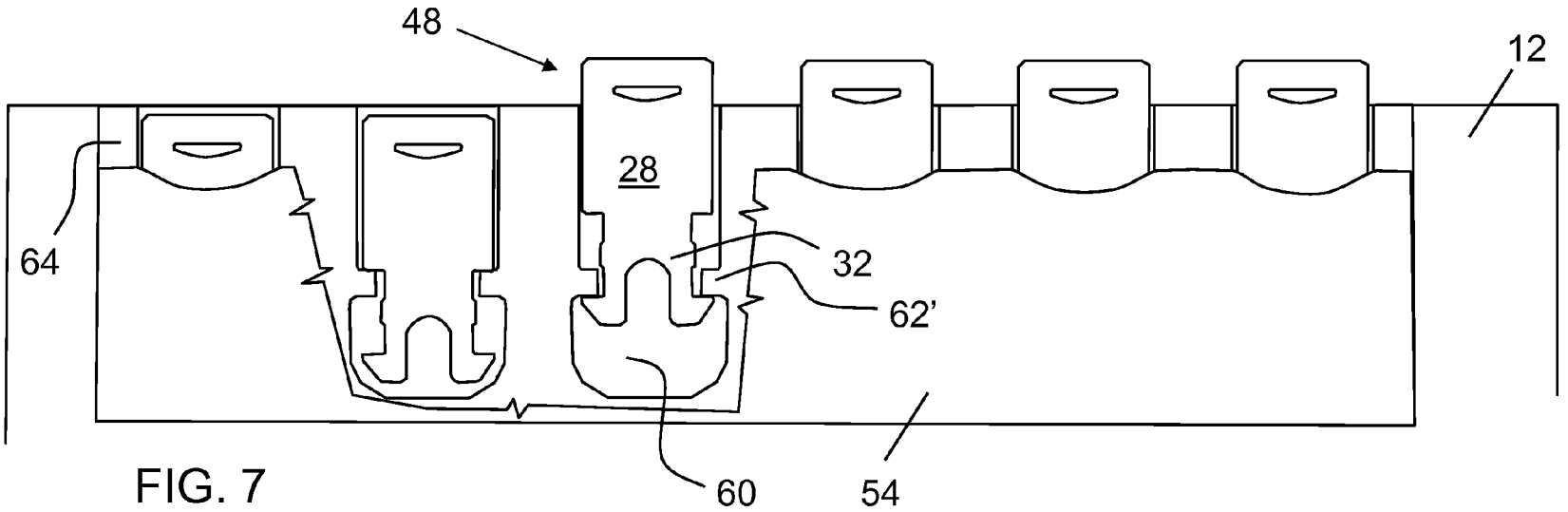
FIG. 7 is an interior, partial cutaway view of a variation on FIG. 5.
Figure 8:
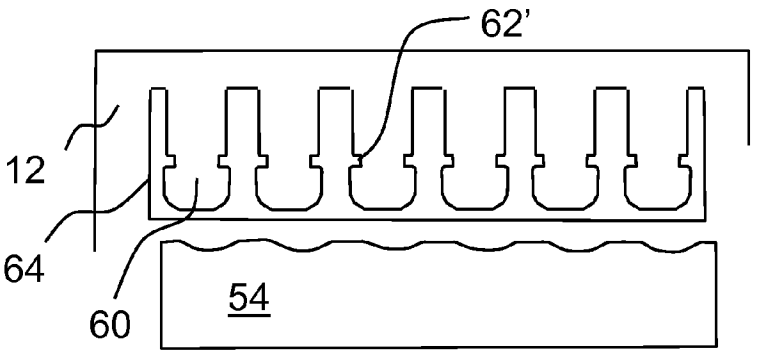
FIG. 8 is a front view of separate parts for creating the structure of FIG. 7.
Figure 9:
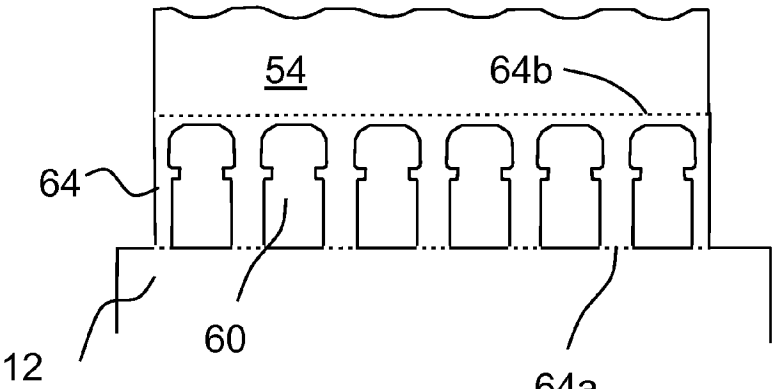
FIG. 9 is a front view of hingedly joined parts for creating the structure of FIG. 8.

FIGS. 7-9 show another example of a retaining panel 54 made of a material such as paper or paperboard (or plastic or other sheet material). Some of the features are similar to those of FIGS. 5-6. A three-layer structure is shown, with a middle layer 64 between front cover 12 and retaining panel 54. As shown in FIG. 7, indicators 48 may be used which have a body 28 and legs 32. The indicators may be slidably received in indicator receiving cavity 60 which may be provided as an opening in middle layer 64, as readily seen in FIGS. 8 and 9. The inner layer may provide features such as inwardly extending parts 62' to engage features on indicator 48. Adhesive or other methods may be used to secure the layers together. Alternately, the inner layer may be omitted (not shown) and features like those provided by the welds in FIG. 5 or the inwardly extending parts 62' be provided by appropriate placement of glue, adhesive, or other attachments suitably positioned between front panel 12 and retaining panel 54.

FIG. 8 shows how a three layer structure may be achieved by combining front cover 12, along with middle layer 64 and retaining panel 54 provided as separate pieces of material. The layers may be attached together using the various methods described above. FIG. 9 shows how a three layer structure may be achieved by providing the middle layer 64 and retaining panel 54 in one piece with the front panel 12, and attached together by fold lines 64*a*, 64*b*, which when folded give the structure shown in FIG. 7. Adhesive or other methods may be used to secure the layers together. Alternately any two of the three layers may be provided hingedly attached together as a first part and the third layer provided separately as a second part.

In the embodiment of FIGS. 5 and 6, and FIGS. 7-9, the indicators 48 are carried on the front panel 12, and therefore each indicator 48 is not positioned immediately adjacent to a tab 24 carried on a divider panel 22. However, each indicator 48 is laterally aligned with an associated tab 24 such that, when the filer 10 is viewed straight-on, through the generally transparent/translucent portion 46 of the cover each indicator 48 is associated with the proper tab 24 (see indicator 48 of FIG. 1). In this embodiment, each indicator 48 may be generally translucent or transparent to enable the tab 24 to be viewed therethrough, although each indicator 48 may also be opaque. If indicator 48 is opaque, a cut-out 44 may be provided of sufficient through which tab 24 may be viewed. In addition, rather than being positioned on the front panel 12, the indicators 48 may also, or instead, be positioned on the rear panel 14. The indicators 48 may be positioned such that each indicator 48 is positioned below the translucent portion 46, and therefore hidden from view, when in the retracted position.

The embodiment of FIGS. 3 and 4 is shown with the indicators 26 on the divider panels 22, and the embodiment of FIGS. 5 and 6, and FIGS. 7-9, is shown with the indicators 48 on the front panel 12. However, if desired the indicators 26 of FIGS. 3 and 4 may also be utilized on the front 12 and/or rear 14 panels, and the indicators 48 of FIGS. 5-9 may be mounted on the divider panels 22, or various combinations thereof may be utilized. If the indicators 48 of FIGS. 5-9 are mounted on the divider panels 22, only one indicator 48, or more than one indicator 48 may be mounted thereon.

Figure 10:
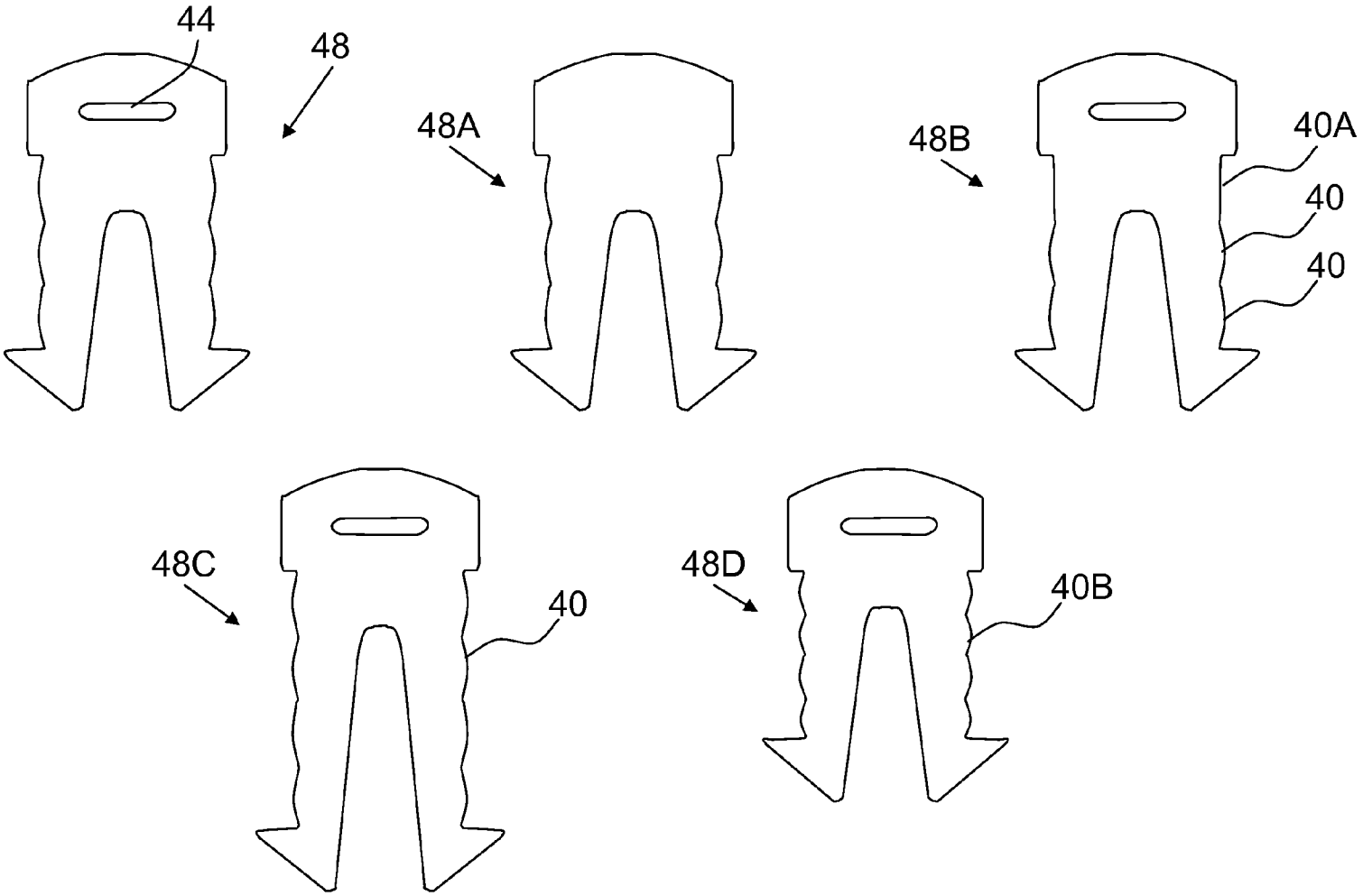
FIG. 10 is a front view of alternative tab indicators.

FIG. 10 shows several example tab indicators, including reference tab indicator 48 previously discussed. Tab indicator 48A by contrast lacks the cutout 44. Tab indicator 48B has two rounded portions 40 and one flat portion 40A on each side. Tab indicator 48C has four rounded portions 40 on each side. The number of slits 42 may be adjusted accordingly. The rounded portions being similar in size to those of tab indicators 48, 48A, and 48B, the length of tab indicator 48C is correspondingly longer to accommodate the extra rounded portion 40. Tab indicator 48D has four rounded portions 40B on each side. The length of tab indicator 48D being similar to that of tab indicators 48, 48A, and 48B, the rounded portions 40B are correspondingly shorter than rounded portions 40. The spacing of slits 42 may be adjusted accordingly, e.g., by being closer together.

Cutout 44 is optional and if used, may have any suitable shape, size, or location. More than one cutout may be present.

Figure 11:
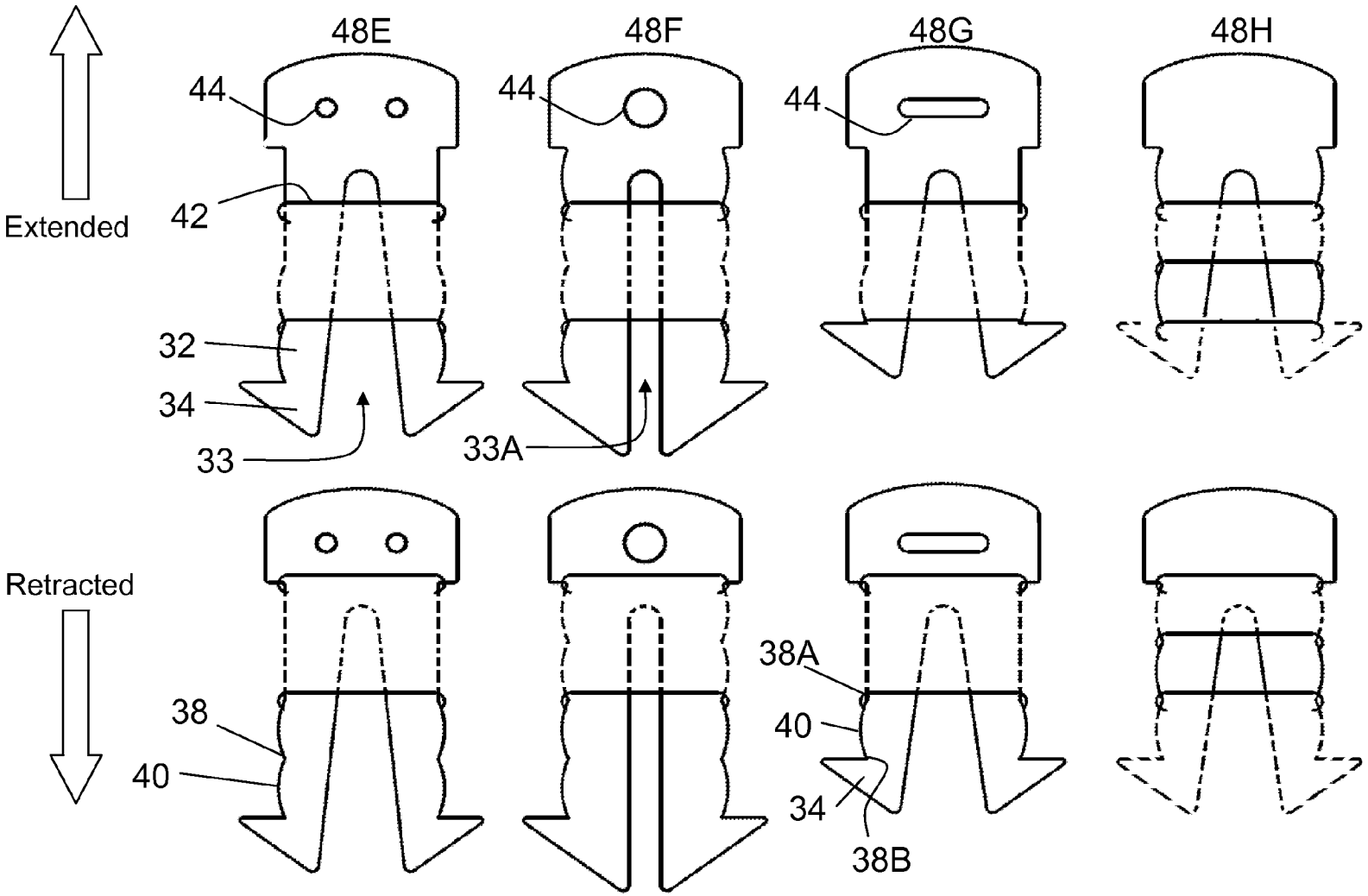
FIG. 11 is a front view of additional alternative tab indicators.

FIG. 11 shows several more example tab indicators in extended positions (upper row) and retracted positions (lower row) as shown relative to their slits 42. Tab indicator 48E has two circular cutouts 44, and the upper portions of legs 32 have straight outer edges, while the lower portions each have two rounded portions 40 with a notch 38 between them. Tab indicator 48F has one circular cutout 44, and legs 32 each have four rounded portions 40 with a notch 38 between them. In contrast to the inverted-vee space 33 between the pair of legs 32 in most of the other tab indicators, tab indicator 48F has an inverted u-shaped space 33A between the pair of legs 32.

Tab indicators 48E and 48F both travel in a pair of slits 42, and may both have an additional position that is further-extended as compared to the position shown in the top row.

Tab indicator 48E has two circular cutouts 44. Tab indicator 48G has one slotted cutout. With tab indicator 48G, the upper portion of legs 32 has straight outer edges, while the lower portion has a single rounded portion 40. The transition point 38A of any rounded portion 40 with a straight portion (for example with tabs 48B, 48E, and 48G) may be considered a 'notch' with a similar function to that of the notches 38 in other tabs, to act as a detent or rest position of the tab. The rest position may either be at a deployed or retracted position, or in between. The transition point 38B of any rounded portion 40 with a foot 34 (for example as seen with 48G and with the other tabs) may likewise be considered a 'notch' with similar function to that described above. Tab indicator 48H lacks any cutout 44, and legs 32 each have three rounded portions 40 with notches 38 between them. Tab indicator 48H travels in three slits 42.

Figure 12A:
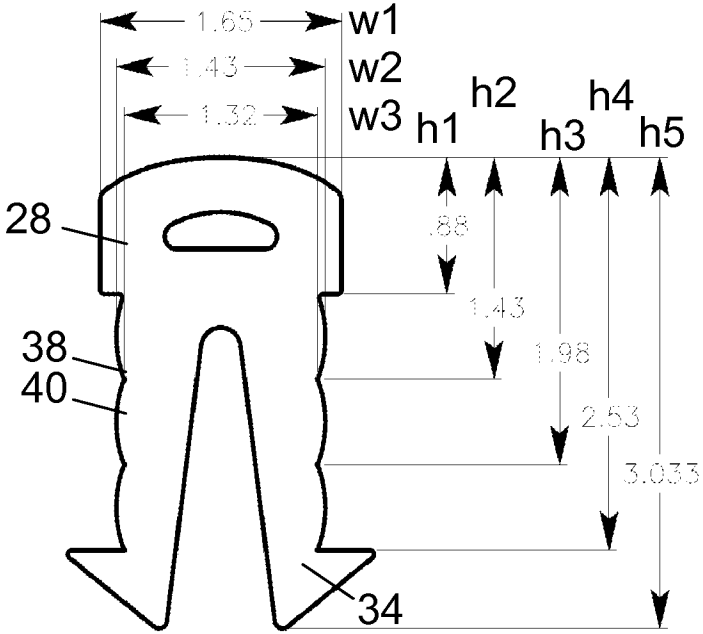
FIG. 12 is a front view of alternative indicator tabs and slits.

FIG. 12A shows some example dimensions for an indicator tab, including respectively widths w1 (1.65") of the body 28, w2 (1.43") between the outward edges of the rounded portions 40, and w3 (1.32") between notches 38. Likewise FIG. 12A shows example lengths of body 28 of h1 (0.88"), and measured from the top of the body, h2 (1.43") to a first notch 38, h3 (1.98") to a second notch, h4 (2.53") to a third notch, and h5 (3.033") to the top of foot 34. Thus the distances between notches (which may also be the distance between adjacent slits 42 as suitable for this indicator tab) is about 0.55", which is also approximately the height of foot 34.

Figure 12B:
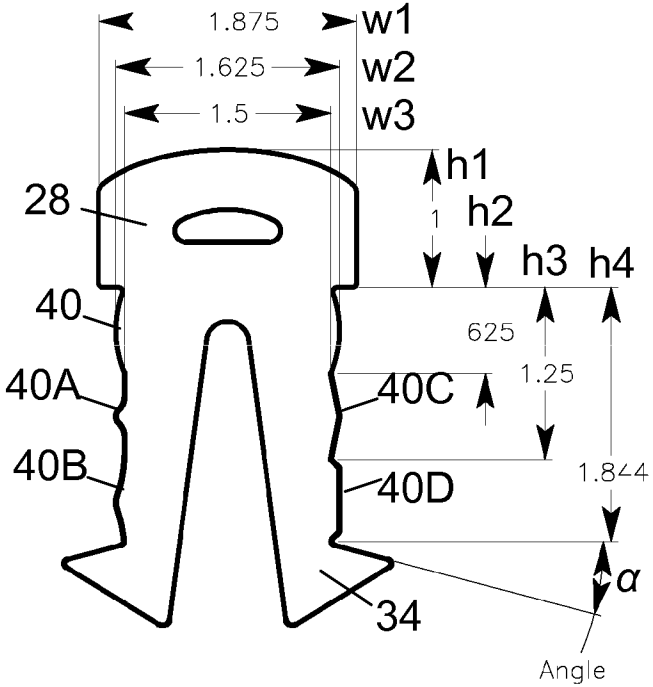

FIG. 12B shows some example dimensions for a larger indicator tab, including respectively widths w1 (1.875") of the body 28, w2 (1.625") between the outward edges of the rounded portions 40, and w3 (1.5") between notches 38. Likewise FIG. 12B shows example lengths of body 28 of h1 (1.00"), and measured from the bottom of the body, h2 (0.625") to a first notch 38, h3 (1.25") to a second notch, and h4 (1.844") to the top of foot 34. Angle alpha is denoted along the top of foot 34, which may be zero (as in FIG. 12A), or slanted as shown in FIG. 12B. FIG. 12B also shows various example shapes that may be used for the "round portions", including an arc shape 40, a cusp 40A, a curved peak 40B, a straight peak 40C, and a plateau 40D.

Figure 12C:
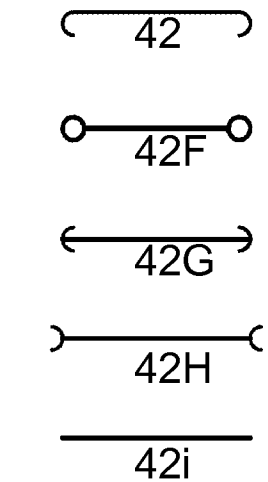

FIG. 12C shows some example shapes for slits, including slit 42 with rounded extensions continuing from the main length of the slit, slit 42F which terminated in two circular (or other shape) holes, slit 42G which terminates in two inwardly curved arcs, slit 42H which terminates in two outwardly curved arcs, and slit 42*i* which is a simple linear slit.

Dimensions and shapes shown in FIGS. 12A, 12B, and 12C are shown by way of example and are not meant to be limiting.

Although the tab indicators 26, 48 are shown in conjunction with a divider panel 22 or cover 12, 14 of a filer 10, it should be understood that the indicators 26, 48 can be used in conjunction with or without tabs of nearly any form, and in a variety of products, such as notebooks, notepads, organizers and the like.

Figure 13A:
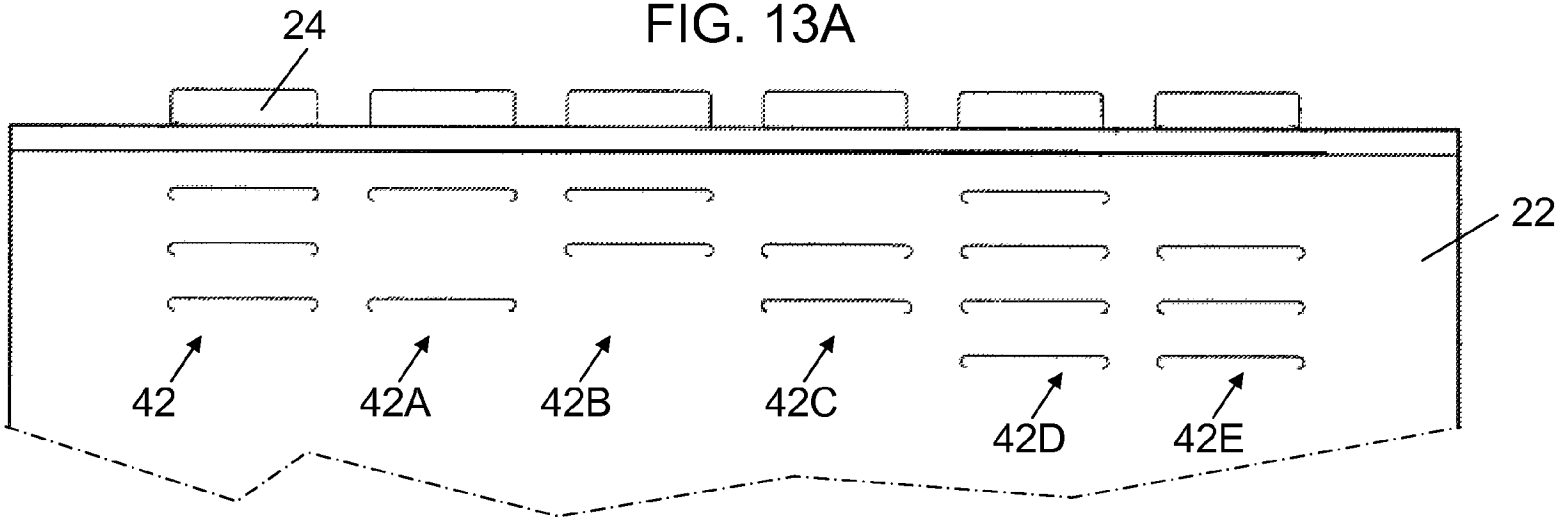
FIG. 13 is a front view of alternative dividers and tab indicators.

FIG. 13A shows an example divider with several alternative arrangements for slits 42. For example as discussed previously there may be three slits 42. Alternately, the middle slit may be omitted resulting in two slits as shown at 42A, or the lower slit may be omitted resulting in two slits as shown at 42B, or the upper slit may be omitted resulting in two slits as shown at 42C. Four slits may be used as shown at 42D. Three slits shifted downward may be used as shown at 42E. Although these alternative slit arrangements are shown on one divider panel 22 in FIG. 13A, it may be more common to use one slit arrangement on a given divider panel. The number of slit grouping may differ from the six groupings shown in FIG. 13A. The spacing and number of the slits may be adjusted according to manufacturing preference. The indicator tabs used with the slits may be modified to best work with a given slit arrangement, for example by adjusting the spacing or number of portions 40.

Figure 13B:
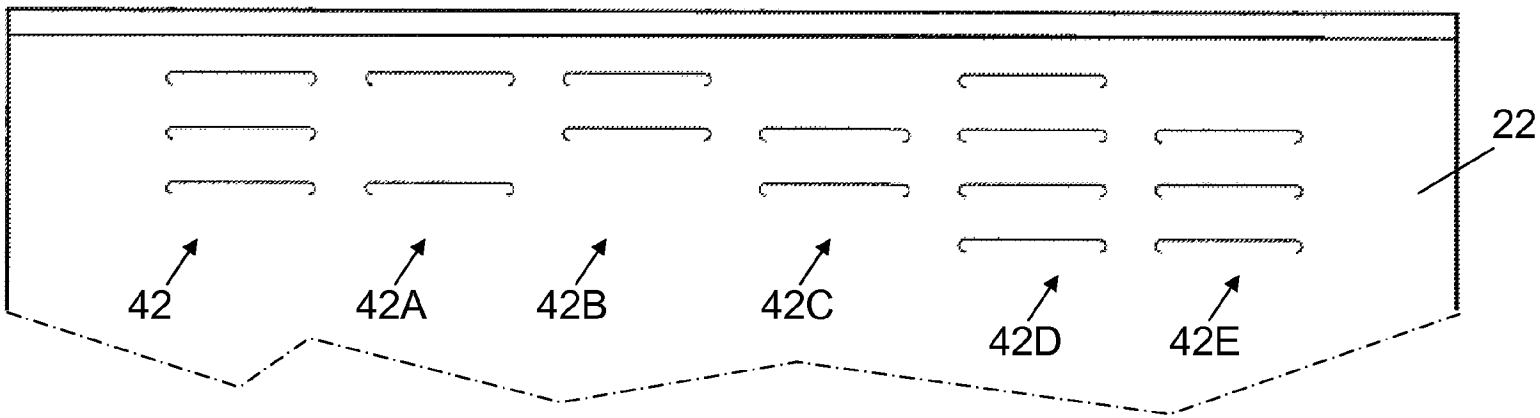

FIG. 13B shows slit arrangements similar to FIG. 13A, but used on a divider panel 22 without any tabs 24.

Figure 14:
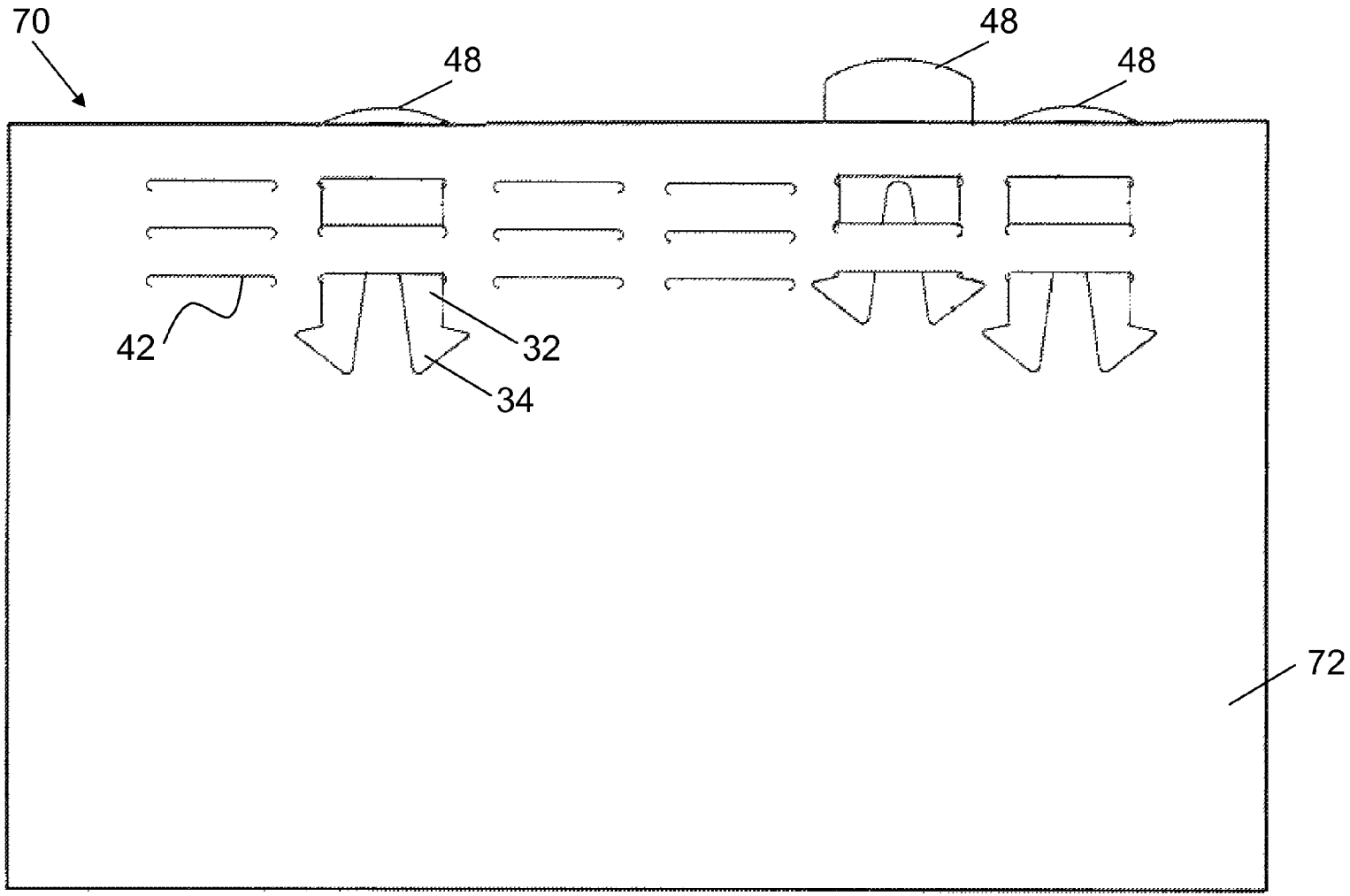
FIG. 14 is a front view of a divider with multiple tab status indicators.

FIG. 14 shows a divider 70 with indicator tabs 48. The divider may include a single sheet 72 which has slits 42 in which to carry one or more indicator tabs 48.

Figure 15:
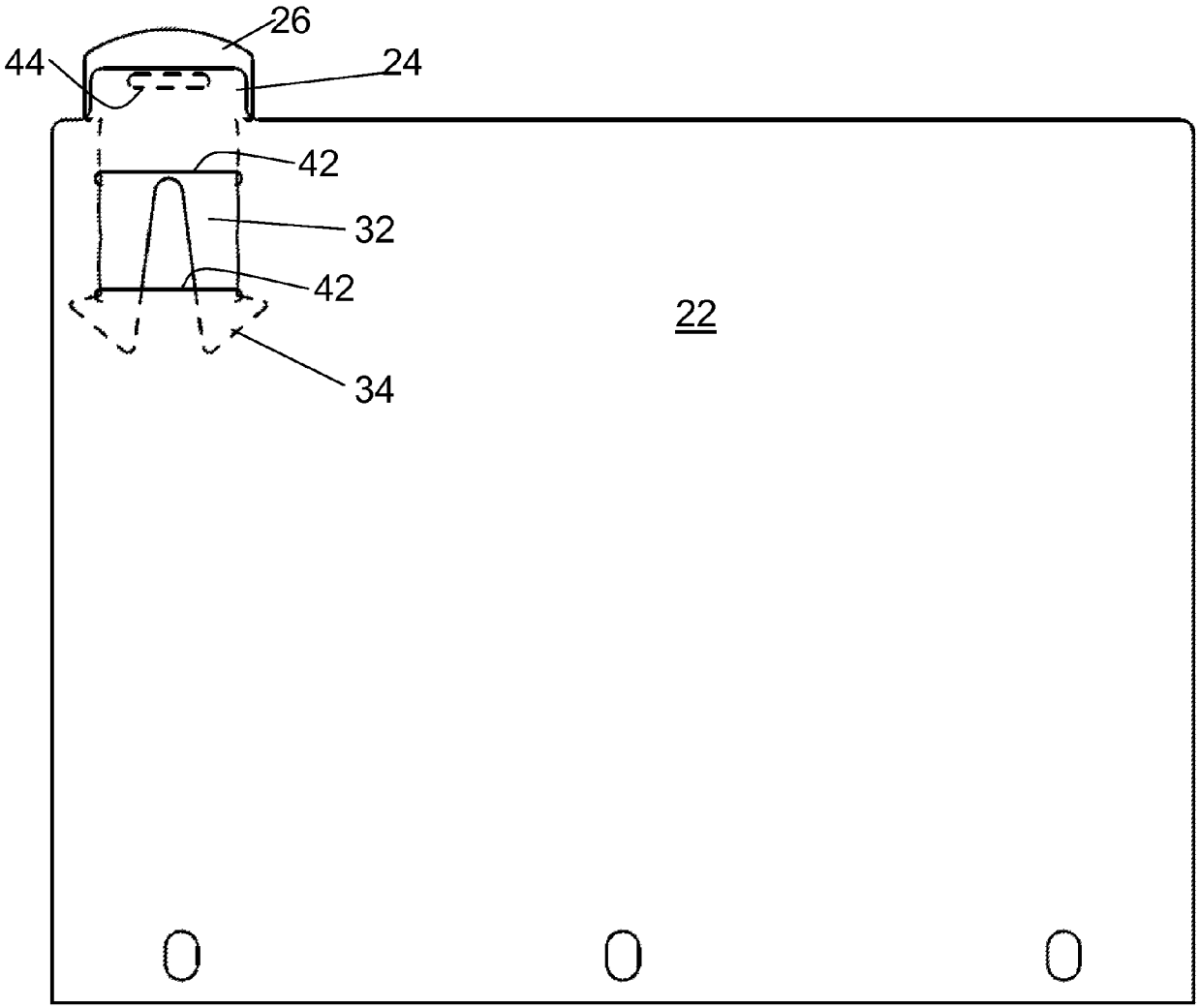
FIG. 15 is a front view of a single divider with a tab status indicator.

FIG. 15 shows a divider 22 with a single tab 24 and associated indicator tab 26 carried in a single pair of slits 42. The indicator tab 26 is shown in its extended position. The divider 22 may be hole-punched for binding into a ring binder (holes shown), a twin-wire or spiral wire notebook (holes not shown), or other device.

Figure 16:
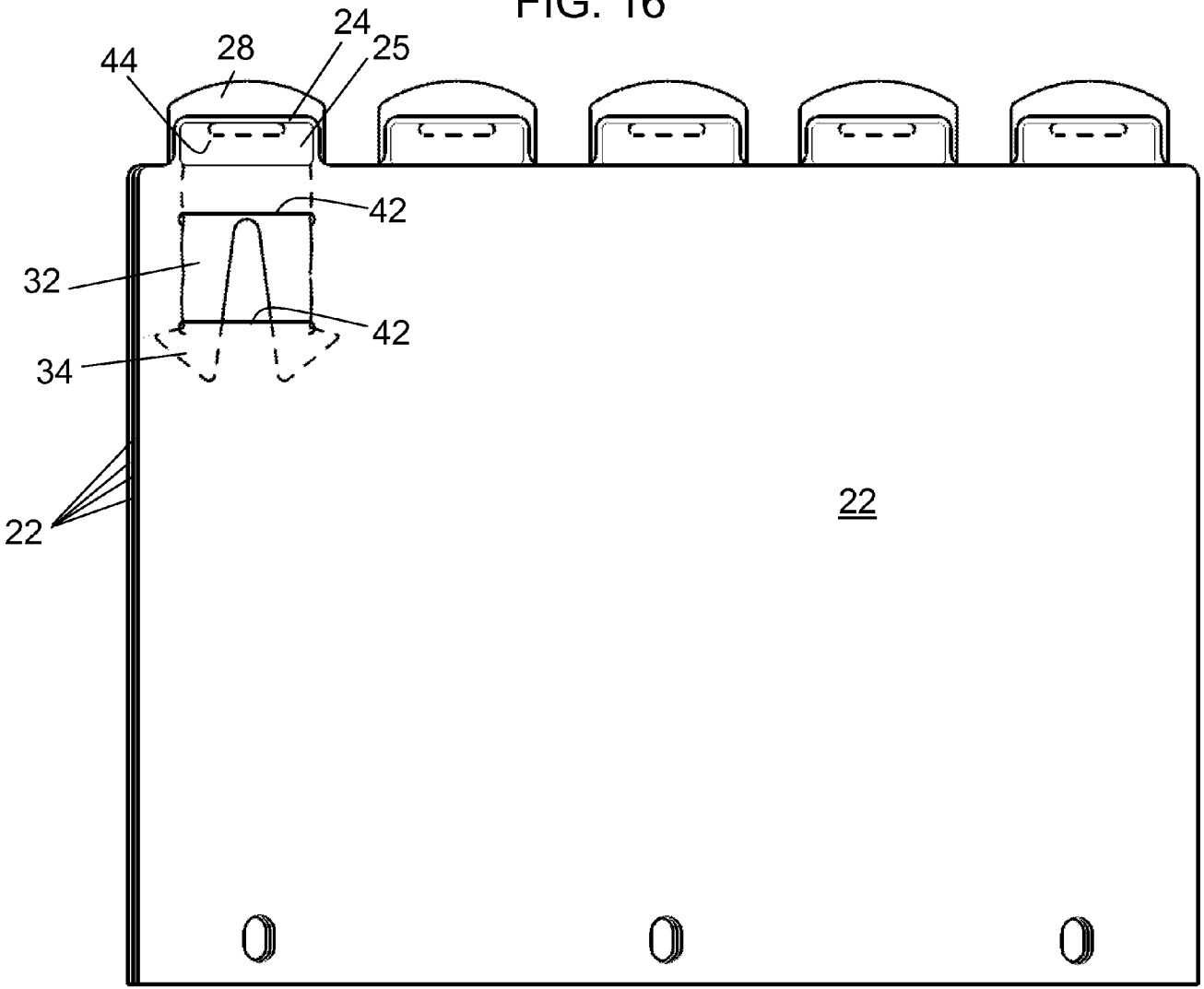
FIG. 16 is a front view of a stack of dividers each with one tab status indicator.

FIG. 16 shows a set of five dividers 22 each with a single tab 24 and associated indicator tab 26 carried in a single pair of slits 42. More or fewer than five dividers may be provided. The indicator tabs 26 are all shown in their extended position, which (as seen from the viewpoint of FIG. 16) is behind the associated tab 24. The dividers 22 may be hole-punched for binding into a ring binder (holes shown), a twin-wire or spiral wire notebook (holes not shown), or other device. The location of the tabs 24 and indicator tabs 26 may be spaced along one or more of the three unbound edges. Depending upon the number of dividers and the user preference, some of the tabs and indicator tabs may overlap those of other dividers. The tabs 24 may carry labels 25 such as preprinted labels, machine printed labels, or hand-written labels to show information particular to each divider.

Figure 17:
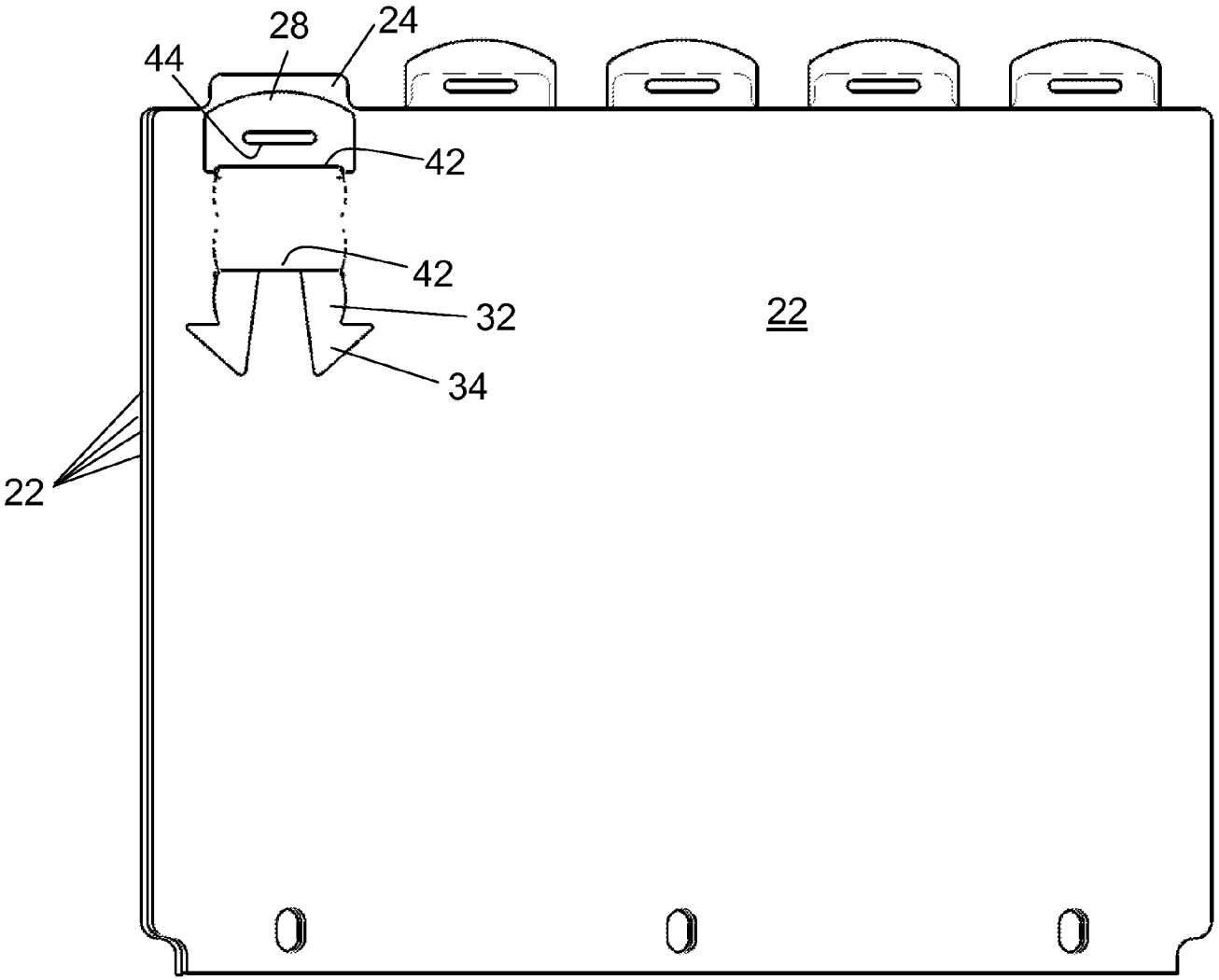
FIG. 17 is a front view of a stack of other dividers each with one tab status indicator.

FIG. 17 shows a set of five dividers 22 with a somewhat different shape, each with a single tab 24 and associated indicator tab 26 carried in a single pair of slits 42. More or fewer than five dividers may be provided. The indicator tab nearest the viewer is shown in a retracted position, while the other indicator tabs 26 are shown in their extended position which (as seen from the viewpoint of FIG. 17) is in front of the respective tab 24. The dividers 22 may be hole-punched for binding into a ring binder (holes shown), a twin-wire or spiral wire notebook (holes not shown), or other device. The location of the tabs 24 and indicator tabs 26 may be spaced along one or more of the three unbound edges. Depending upon the number of dividers and the user preference, some of the tabs and indicator tabs may overlap those of other dividers.

Figure 18:
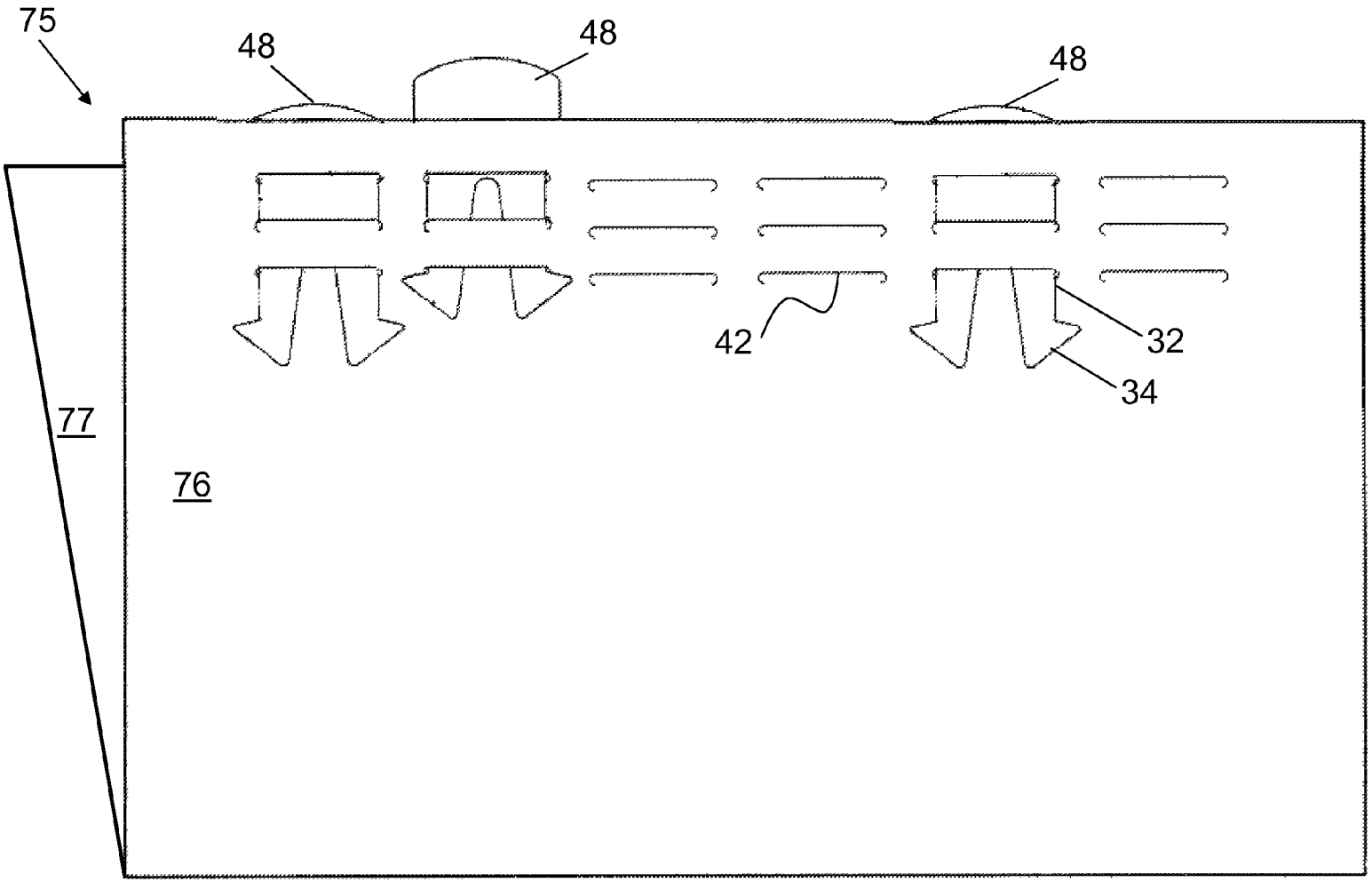
FIG. 18 is a front view of a folder with multiple tab status indicators.

FIG. 18 shows a folder 75 with indicator tabs 48. The folder 75 may include a front panel 76 hingedly or foldably connected to a back panel 77. The hinged or folded connection between the front panel 76 and back panel 77 may be at an edge of the front panel opposed from the edge carrying the indicator tabs 48. However, in an alternative embodiment (not shown), the indicator tabs may be located along one of the two "end" edges of the folder adjacent to the hinged or folded edge. Either the front panel 76 (as shown) or the back panel 77, or both, may have slits 42 in which to carry one or more indicator tabs 48.

Figure 19:
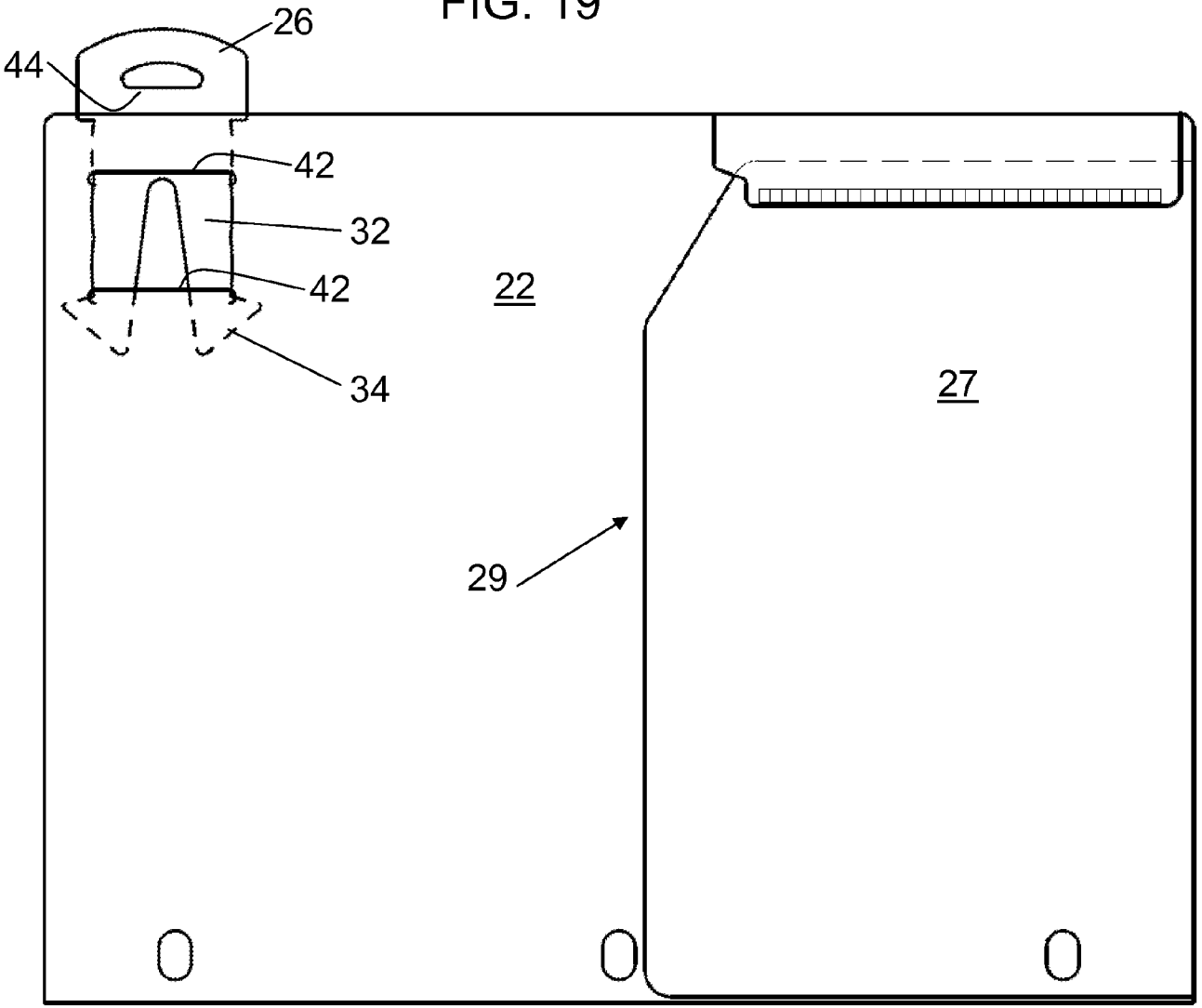
FIG. 19 is a front view of a pocket divider with a tab status indicator.

FIG. 19 shows a divider 22 with pocket panel 27 defining a pocket 29. The divider is provided with an indicator tab 26. The indicator tab 26 is shown on an edge opposite from any binding holes (e.g. for a ring binder as shown, or spiral or other binding (not shown). However the indicator tab may also be located at an edge adjacent to a bound or binding edge where the divider 22 may have slits 42 in which to carry one or more indicator tabs 48.

Figure 20:
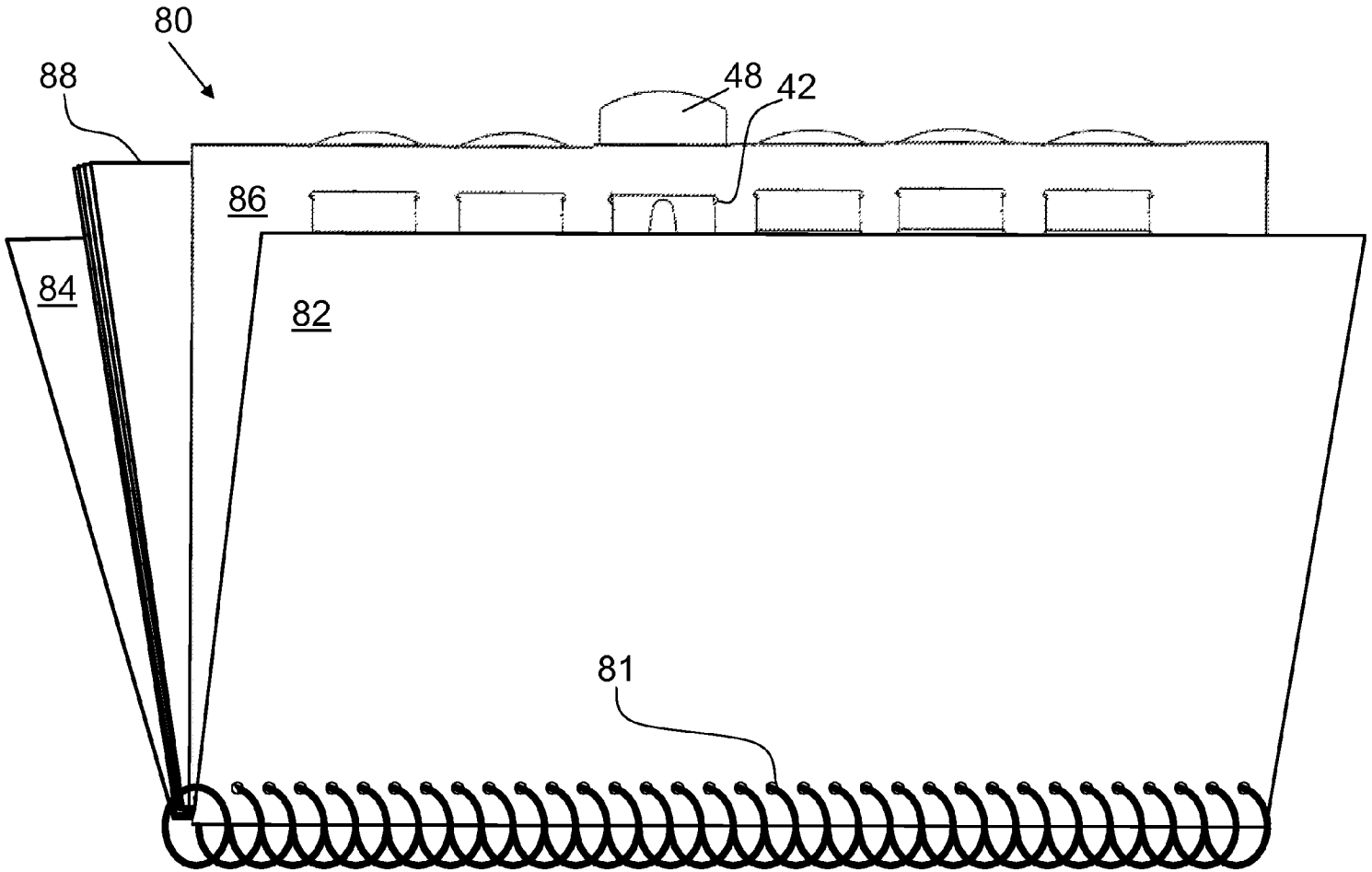
FIG. 20 is a front view of a notebook with tab status indicators.

FIG. 20 shows a notebook 80 with indicator tabs 48. The notebook 80 may include a front cover 82, rear cover 84, and binding mechanism 81 such as a wire coil, spiral, twin-wire, sewn binding, glued binding, clasp binding, or other binding mechanism. The binding mechanism 81 may be at a "side" edge of the notebook opposite from the indicator tabs. However in an alternative embodiment (not shown), the indicator tabs may be located along a "top" or "bottom" edge of the notebook adjacent the bound edge. One or more pages 88 may be contained within the notebook. As shown in FIG. 20, an internal page 86 may have slits 42 in which to carry one or more indicator tabs 48. The notebook 80 may have more than one such internal page 86 with tab indicators. Alternately or in addition, slits for carrying indicator tabs may be provided on the front cover 82, rear cover 84, pages 88, or combinations thereof.

Although the invention is shown and described with respect to certain embodiments, it should be clear that modifications will occur to those skilled in the art upon reading and understanding the specification, and the present invention includes all such modifications.

The invention claimed is:

1. A tab status indicator system including:

a generally planar body portion;

a tab coupled to said body portion and protruding generally outwardly therefrom; and an indicator movable between a deployed position, in which the indicator generally overlaps with said tab in a direction generally perpendicular to a plane of said body portion, and a retracted position, in which the indicator does not overlap with said tab or overlaps with said tab less than when said indicator is in said deployed position.

2. The tab status indicator system of claim 1 wherein said indicator is slidably coupled to said body portion.

3. The tab status indicator system of claim 2 wherein the body portion includes a plurality of slits formed therein, and wherein said tab is passed through said slits to slidably couple the tab to the body portion.

4. The tab status indicator system of claim 3 wherein said indicator includes a body and a pair of legs extending therefrom, each leg having at least one notch positioned thereon, each notch being configured to receive an end of a slit therein to retain each indicator in place until sufficient force is applied thereto.

5. The tab status indicator system of claim 1 further comprising a generally planar cover panel coupled to said body portion and generally parallel therewith, wherein said indicator is slidably coupled to said cover panel.

6. The tab status indicator system of claim 5 further comprising a retaining panel coupled to said cover panel, wherein said indicator is positioned between said retaining panel and said cover panel.

7. The tab status indicator system of claim 6 wherein the retaining panel is coupled to the cover panel by a pair of welds, each weld being positioned on either side of the indicator, and wherein the indicator includes a pair of protrusions, each protrusion being shaped and positioned to engage one of the welds when the indicator is moved between the retracted and the deployed positions.

8. The tab status indicator system of claim 1 wherein the indicator is movable in a direction generally parallel to the plane of the body portion when the indicator moves between the deployed and the retracted positions.

9. The tab status indicator system of claim 1 wherein the indicator is sized and configured to extend beyond the tab when the indicator is in the deployed position.

10. The tab status indicator system of claim 1 wherein indicator is positioned inside a filer, and wherein the filer includes a generally transparent portion through which the indicator is visible when the indicator is in the deployed position.

11. The tab status indicator system of claim 1 wherein said system is configured such that a user experiences resistance when manually moving the indicator between the deployed and retracted positions such that the indicator snaps into place when arriving at the deployed and retracted positions.

12. The tab status indicator system of claim 1 further including at least two stops which limit or prevent movement of the tab beyond the deployed position and the retracted position.

13. The tab status indicator system of claim 1 further comprising a plurality of indicators movable between a deployed position, in which the indicator generally overlaps with an associated tab in a direction generally perpendicular to a plane of said body portion, and a retracted position, in which the indicator does not overlap with the associated tab or overlaps with the associated tab less than when the indicator is in the deployed position.

14. A tab system including:

a generally planar body portion;

a tab coupled to said body portion and movable between a fully deployed position, in which the tab generally protrudes outwardly from said body portion, and a retracted position, in which the tab does not generally protrude outwardly from said body portion, and wherein said tab is positionable in an intermediate position between said fully deployed position and said retracted position, wherein said tab is stably positionable in said fully deployed position, said intermediate position, and said retracted position, which are discrete, spaced apart positions, and wherein said tab is more stably held in position when in one of said discrete, spaced apart positions than when not in one of said discrete, spaced apart positions.

15. The tab system of claim 14 further comprising a retaining system for stably retaining said tab in each of said fully deployed position, said retracted position, and said intermediate position.

16. The tab system of claim 14 wherein the body portion includes a plurality of slits formed therein, and said tab extends through said slits to slidably couple the tab to the body portion, wherein said tab includes a body and a pair of legs extending therefrom, each leg having at least one notch positioned thereon at an intermediate position along a length thereof, each notch being configured to engage an end of one of said slits to retain said tab in place.

17. The tab system of claim 14 wherein said body portion includes at least two slits, and wherein said tab slidably extends through both of said slits.

18. An indicator device comprising:

a generally planar body portion including at least two slits formed therein; and an indicator extending through both of said slits and slidably movable between a non-deployed position and a deployed position in which the indicator extends outward from the body portion further than when in the non-deployed position, wherein the indicator slides generally in the plane of the body portion, wherein said indicator includes a body and a pair of legs extending therefrom, each leg having at least one notch positioned thereon, each notch being configured to engage an end of one of said slits to retain said indicator in place.

19. The indicator device of claim 18, further comprising a second generally planar portion hingedly attached to the planar body portion.

20. The indicator device of claim 19 in the form of a folder.

21. The indicator device of claim 18, further comprising a plurality of pages and a binding mechanism binding said indicator device and said pages.

22. The indicator device of claim 18 wherein each leg includes at least two spaced apart notches positioned on an outer surface thereof, each notch being configured to engage one of said ends of one of said slits.

23. The indicator device of claim 18 wherein said indicator includes a gap positioned between said legs such that said legs are deformable toward each other to fit through one of said slits.

* * * * *